US006752198B2

(12) United States Patent
Heijkoop et al.

(10) Patent No.: US 6,752,198 B2
(45) Date of Patent: Jun. 22, 2004

(54) BIMETALLIC PLATE

(75) Inventors: Teunis Heijkoop, Highbury (AU); Ian Robert Dick, Linden Park (AU); Bernard Bednarz, Ottoway (AU); Geoffrey Martin Goss, Happy Valley (AU); Philip David Pedersen, Salisbury North (AU); Robert Sidney Brunton, Sutherland (AU); William Trickett Wright, Birchgrove (AU)

(73) Assignee: Commonwealth Scientific and Industrial Research Organisation of Campbell, Act (AU)

( * ) Notice: Subject to any disclaimer, the term of this patent is extended or adjusted under 35 U.S.C. 154(b) by 0 days.

(21) Appl. No.: 10/308,675

(22) Filed: Dec. 3, 2002

(65) Prior Publication Data

US 2003/0141034 A1 Jul. 31, 2003

Related U.S. Application Data

(63) Continuation-in-part of application No. 09/673,199, filed as application No. PCT/AU99/00281 on Apr. 16, 1999, now abandoned.

(30) Foreign Application Priority Data

Apr. 16, 1998 (AU) ..... PP2982

(51) Int. Cl.[7] ..... B22D 19/04
(52) U.S. Cl. ..... 164/112; 164/332; 164/334
(58) Field of Search ..... 164/100, 94, 95, 164/98, 99, 101, 102, 103, 107, 111, 112, 120, 332, 334

(56) References Cited

U.S. PATENT DOCUMENTS 4,953,612 A * 9/1990 Sare et al. ..... 164/102

FOREIGN PATENT DOCUMENTS

| | | | | |
|---|---|---|---|---|
| AU | 203576 | * 11/1954 | ..... | B22D/19/00 |
| JP | 55-75878 | * 6/1980 | ..... | B22D/19/00 |
| JP | 6-269925 | * 9/1994 | ..... | B22D/19/00 |
| SU | 561618 | * 8/1977 | ..... | B22D/19/00 |
| SU | 1131594 | * 12/1984 | ..... | B22D/19/00 |
| SU | 1210976 | * 2/1986 | ..... | B22D/19/08 |
| SU | 1224101 | * 4/1986 | ..... | B22D/11/10 |

* cited by examiner

*Primary Examiner*—Kiley Stoner
*Assistant Examiner*—Kevin P. Kerns
(74) *Attorney, Agent, or Firm*—Ladas & Parry

(57) ABSTRACT

Bimetallic plate is produced by providing a substrate of a first metal and, with the preheated substrate positioned in a mold cavity with a major surface of the substrate facing upwardly and to fill a portion of the depth of the cavity, a second metal is cast against that surface to form a cladding component and, with the substrate, to form the bimetallic plate. Prior to the cladding being cast, the major surface is rendered substantially oxide-free and is protected against oxidation. The cladding is cast by a melt, of a composition required for it, being poured at a superheated temperature whereby, with the preheating of the substrate, an overall heat energy balance is achieved between the substrate and the cladding. The heat energy balance causes a diffusion bond to be achieved between the major surface of the substrate and the cladding, and attainment of the energy balance is facilitated by causing the melt to enter the mold cavity through a series of gates which provide communication between at least one runner and the mold cavity. The series of gates is disposed laterally with respect to flow of the melt therethrough whereby the melt forms a laterally extending melt front. Attainment of the heat energy balance is further facilitated by causing the melt front to advance away from the gates, over the substrate surface, at a rate which is substantially uniform across the lateral extent of the front.

24 Claims, 7 Drawing Sheets

20b
49a
49b
49c
70
71
72
74
75

BIMETALLIC PLATE

RELATED U.S. APPLICATION DATA

This application is a continuation-in-part of application Ser. No. 09/673,199, filed on Jan. 8, 2001, now abandoned, filed as a 371 of international application No. PCT/AU99/00281, filed on Apr. 16, 1999.

BACKGROUND OF THE INVENTION

This invention relates to a process, and to molding apparatus, for the production of composite metal articles comprising bimetallic plate.

Numerous prior art proposals for producing composite metal articles are discussed in U.S. Pat. No. 4,953,612 to Sare et al (filed as PCT/AU84/00123). Those proposals suffer from various disadvantages or limitations, at least some of which are overcome by the teaching of U.S. Pat. No. 4,953,612. The teaching of U.S. Pat. No. 4,953,612 is well suited for the manufacture of a range of composite metal articles comprising a cast component bonded to a substrate component. However, the teaching is less well suited for the production of a composite metal article comprising bimetallic plate, in particular plate which is relatively thin and/or has a relatively large surface area. Thus, the teaching of U.S. Pat. No. 4,953,612 can encounter difficulties, such as uneven bonding, in the production of bimetallic plate in sizes greater than about 300×300 mm, with a thickness of less than about 30 mm and a thickness ratio of about 1:1 or less for cast metal to substrate.

The present invention seeks to provide a process and molding apparatus which enables production of relatively large area, bimetallic plate, such as up to and in excess of 1800×1500 mm, while indications are that plate at least up to 3000×1650 mm is able to be produced.

In the process of the present invention a plate (hereinafter referred to as a "substrate"), which is formed of a first metal, has a component (hereinafter referred to as "cladding") of a second metal cast against it to form bimetallic plate. The first metal for the substrate may be titanium, nickel or cobalt, a ferrous alloy or a titanium-, nickel- or cobalt-base alloy. The second metal for the cladding may be copper, nickel or cobalt, a ferrous alloy or a copper-, nickel- or cobalt-base alloy. While not necessarily the case, the first and second metals usually are compositionally different. However, where the first and second metals are the same or similar, in being closely related compositionally, this can be to achieve a difference in properties based on microstructure, such as due to the substrate being hot- or cold-worked and the cladding having an as cast microstructure.

As in U.S. Pat. No. 4,953,612, the surface of the substrate against which molten alloy is to be cast to form the cladding needs to be rendered substantially oxide-free. Also, the substrate is preheated and is protected against oxidation by a suitable coating. The coating may be formed from flux which is applied over the substrate surface, and melted to form a protective film during preheating. However, other protective coatings can be used, such as a deposit of a suitable metal formed for example by electroless or electrolytic plating of nickel or another metal, or a non-metallic coating such as of colloidal graphite containing a silicate binder. Depending on the protective coating use, it is either displaced by or alloyed with the alloy cast to form the cladding, facilitating wetting of the substrate surface by the cast alloy.

Also as in U.S. Pat. No. 4,953,612, the molten alloy to form the cladding is poured at a superheated temperature to facilitate the attainment, with preheating of the substrate, of an overall heat energy balance to achieve a diffusion bonding between the cladding and the substrate. The diffusion bond is obtained substantially in the absence of fusion of the substrate surface against which the cladding is cast.

In the production of bimetallic plate, it can be very difficult to achieve a sufficient heat energy balance for good bonding between the cladding and substrate. This is particularly the case where the plate is large in area, and/or relatively thin and/or has a relatively low thickness ratio of cladding to substrate. Under these conditions, it is found that loss of heat energy to the mold becomes a significant factor preventing the attainment of such energy balance, with this loss being from both the preheated substrate and from the molten alloy as it flows over the substrate. This loss can be exacerbated by delays between preheating the substrate and pouring the molten alloy to provide the cladding and/or by an unduly long period during which the molten alloy is poured. Also, it is found that loss of uniformity of heat energy balance, with resultant non-uniformity of bonding, can result from uncontrolled or irregular flow of molten alloy over the substrate, such as to give rise to an unduly long flow path and/or a reducing flow rate for the alloy.

SUMMARY OF THE INVENTION

We have found that substantially improved bimetallic plate can be produced by controlled casting of molten, alloy to provide the cladding. In the process of the invention, the cast alloy is caused to flow across the surface of the substrate along a controlled melt front which is advanced in a manner which, having regard to the temperature to which the substrate is preheated and the superheat temperature of the molten alloy, provides over substantially the entire surface of the substrate a heat energy balance within limits sufficient for achieving a diffusion bond between the cladding and substrate.

While not necessarily the case, the bimetallic plate may be square or other rectangular form. For ease of further description, a rectangular substrate and resultant plate is assumed in the following. Also for ease of description, directions across the substrate are designated as longitudinal, for the direction in which the melt front advances, and lateral for the direction in which the melt front extends transversely with respect to its direction of advance. However, while the substrate and resultant plate may have a longitudinal extent which is greater than its lateral extent, the converse may apply or the longitudinal and lateral extents may be substantially equal. Additionally, while the longitudinal direction of melt front advance can be substantially between longitudinally opposite edges of the substrate, longitudinal melt advance can be over part of the longitudinal extent of the substrate. Moreover, the lateral extent of the melt front and, hence, the width of cladding in that direction, may be over substantially the full lateral extent of the substrate or over a part of that extent.

In the process of the present invention, a controlled melt front is advanced in a manner providing required heat energy balance for bonding by at least one of the following features:

(a) causing the molten alloy to enter a mold cavity, in which the substrate is positioned, through a laterally disposed series of gates providing communication between a runner and the mold cavity, whereby the molten alloy forms a laterally extending melt front, and (b) causing the melt front to advance longitudinally over the substrate at a rate which is substantially uniform across the lateral extent of the melt front.

The process of the invention preferably utilizes each of features (a) and (b).

Thus, according to the present invention, there is provided a process for the production of a composite bimetallic plate, wherein the process comprises the steps of:

(a) rendering a major surface of a substrate plate formed of a first metal substantially oxide-free;

(b) providing a suitable coating over said oxide-free major surface whereby said major surface is protected against oxidation;

(c) preheating the substrate plate to a sufficient temperature;

(d) positioning the substrate plate in a mold cavity of a mold with said major surface facing upwardly and substantially horizontally to thereby fill a lower portion of the depth of the mold cavity;

(e) securing the substrate plate in the mold cavity; and (f) casting a cladding of a second metal over said major surface of the substrate plate to form, with the substrate plate, said bimetallic plate wherein said cladding is cast by pouring, at a sufficient superheated temperature, a melt of the second metal for flow of the melt into the mold cavity to fill an upper portion of the depth of the mold cavity, wherein the securing step (e) secures the substrate plate whereby the substrate plate is substantially restrained against buckling during the casting step (f), and wherein the temperature to which the substrate plate is preheated in step (c) and the superheated temperature of step (f) achieve an overall heat energy balance between the first and second metals whereby a diffusion bond substantially free of fusion of the major surface of the substrate plate is achieved therebetween on solidification of the melt;

and wherein the process further comprises the steps of:

(g) causing the melt poured in step (f):

(i) to flow in at least one elongate runner which extends along a first edge of the substrate plate, and (ii) to enter the mold cavity through a series of gates providing communication between the runner and the mold cavity along said first edge of the substrate plate, whereby the melt is at substantially the same pressure at each gate and on entering the mold cavity forms a laterally extending melt front along said first edge of the substrate plate; and (h) causing the melt to fill the upper portion of the mold by said melt front advancing over said major surface away from said first edge at a rate which is substantially uniform across the lateral extent of the melt front, whereby attainment of the required heat energy balance is facilitated.

The invention also provides a molding apparatus, for use in producing composite bimetallic plate comprising:

a mold having a drag section and a cope section which together define a mold cavity having a form substantially corresponding to bimetallic plate to be produced therein;

at least one elongate runner defined by the mold and extending along a first end of the mold cavity; and a series of laterally spaced gates which are defined by the drag and cope sections of the mold and which provide communication between the at least one runner and the mold cavity at said first end;

wherein a lower portion of the mold cavity is defined by the drag section of the mold and has a substantially flat, substantially horizontal support surface which extends between said first end and a second end of the mold cavity remote from the first end, and on which a substrate metal plate is positionable whereby a major surface of the plate faces upwardly and is substantially horizontal; and wherein the apparatus further comprises means for securing a substrate positioned on said support surface and thereby restraining the substrate plate against buckling during casting of cladding thereon.

To enable attainment of feature (a), molding apparatus according to the invention includes a mold defining a mold cavity in which a substrate is positionable, and in which molten alloy is able to be cast against an upper surface of the substrate. The mold defines at least one feed sprue by which molten metal is receivable, with the feed sprue communicating with at least one lateral runner by which molten metal passes from the feed sprue to each gate of the series. At least where the cladding is to extend from a transverse edge of the upper surface of the substrate which is adjacent to the series of gates, the mold cavity may have a galley portion at which the gates communicate with the cavity.

In a casting operation with a mold providing for feature (a) molten metal flows into the mold cavity via each gate with streams of molten metal from successive gates merging to generate a molten metal melt front which passes longitudinally over the upper surface of the substrate. Where the mold cavity has a galley portion, the merging of streams preferably occurs in the galley portion before the melt front reaches the substrate.

To enable attainment of feature (b), the lateral runner may be configured substantially to equalize metal pressure at each gate of the series. For this purpose, the runner can decrease in cross-section after each successive gate in a direction extending laterally away from the feed sprue, such as by the runner having stepwise reductions in its depth. Additionally, or alternatively, attainment of feature (b) can be facilitated by the mold being configured so that the substrate, when positioned in the mold cavity, has its upper surface inclined upwardly from the feed sprue, i.e. inclined upwardly in the direction of melt front advance. Thus, across its lateral extent, the melt front is constrained to a substantially uniform advance, under the influence of gravity.

While it usually is preferred for the substrate to have its upper surface substantially horizontal or inclined upwardly from the feed sprue, there can be benefit in having the surface slightly inclined downwardly from the sprue. That is, the upper surface may be inclined downwardly in the direction of melt front advance. The downward inclination has the benefit of increasing the flow velocity of the metal. The extent to which the inclination is possible is dependent upon melt viscosity, and the magnitude of the inclination needs to be limited so as to ensure that a substantially uniform rate of melt front advance is maintained across the lateral extent of the front.

Sand molds have been found to be well suited for use in the present invention, although a castable refractory material can be used instead of sand to form the molds. The mold is designed to separate in two main sections, namely a drag section and a cope section. The drag and the cope sections preferably are contained in steel mold support frames by which the mold sections can be clamped together, such as mechanically or hydraulically. The drag section has a cavity in which the substrate is positionable and which forms at least part of the mold cavity. The drag section may have a sprue well into which molten alloy is received from the feed sprue, while it also may have at least one lateral runner. The cope section has the bottom part of the feed sprue, while it may have a cavity which forms part of the mold cavity and in which the cladding is cast. The cope section also may have the lateral series of gates and remote from the feed sprue bottom part and the gates, the cope section may have a lateral cavity for receiving excess cladding alloy.

The mold sections preferably are able to be clamped together with a clamping force which, in combination with the mold design, ensures adequate mold sealing and adequate restraint on the substrate edges during the cladding operation is able to be achieved. Thus, recourse to sealing aids provided between opposed or mating surfaces of the mold sections can be avoided, with a saving in time between preheating the substrate and closing the mold in preparation for casting cladding alloy.

In one suitable arrangement, the draft and cope sections of the mold are made, in their respective support frames, from a molding sand and a binder, such as a sodium silicate binder or an organic binder. A silica sand is suitable, although other molding sands such as olivine or zircon sands can be used. To reduce erosion by molten alloy, critical areas of the runner and gating system may be molded from bonded sand, such as silicate bonded sand selected from olivine, zircon or chromite sand or, if molded from silica sand, those areas can be protected by refractory mold paint. Also, to improve the surface finish of the cast cladding, the mold cavity surface of the cope section may be coated with a refractory mold paint. The support frame for each section may be constructed from fully welded mild steel channel sections, preferably with the drag section frame including a steel bar passing underneath the sprue well to support the sand against the force of poured molten alloy.

In the mold of that arrangement, the dimensions of the cavity in the drag section, particularly in the lateral and longitudinal directions, are sufficient to allow for thermal expansion of the substrate. However, when the substrate is positioned in that cavity, its upper surface preferably is flush with an opposed, peripheral, upper surface of the drag section by which the latter is engaged by a peripheral, lower surface of the cope section. The cope section, when clamped to the drag section, preferably acts to provide a clamping action on margins of the substrate, such as detailed later herein.

As indicated, the substrate is preheated prior to the casting of cladding alloy. It is highly desirable that there be minimum delay between the completion of preheating and the commencement of casting, while preheating the substrate after it is positioned in the drag section cavity is the most practical option. In practice, it is not possible to completely uniformly preheat the substrate and, as a result, the substrate deforms or buckles, usually by a central region bowing upwardly but with some lifting at edges also being likely. Casting of cladding alloy with the substrate in this form exacerbates deformation or buckling and further makes difficult the production of useful bimetallic plate. Also, the deformation or buckling can be such as to make difficult the attainment of feature (b) detailed above. Thus, the deformation or buckling of the substrate therefore needs to be minimized or obviated, Threaded metal studs welded to the lower surface of the substrate and restrained by nuts tightened against the drag mold frame can be used to offset or prevent deformation or buckling of the substrate. The deformation or buckling alternatively can be offset by utilizing the force by which the drag and cope sections of the mold are clamped together, so as to generate compressive loads acting to press the substrate to an approximately flat condition. In one suitable procedure for this, a series of laterally spaced, longitudinally extending metal strips are tack-welded to the upper surface of the substrate, thus forming longitudinal channels on the substrate along which the cast alloy is able to flow. In still another suitable procedure, a plurality of metal chaplets are tack-welded to the upper surface of the substrate in a suitably disposed array. The metal strips, which are dimensioned to form channels of a depth corresponding substantially to the required cladding thickness, may be of a similar composition to the cast alloy and become incorporated therein as part of the cladding. The chaplets, which have a thickness corresponding substantially to the required cladding thickness, also may be of similar composition and become incorporated in the cladding.

On closing the mold and clamping the drag and cope sections together, the clamping force causes the cope section to engage the strips or chaplets with generated compressive forces thereby acting to force the substrate down against the drag section. The substrate can be forced into a somewhat flat condition, but with minor bowing between successive strips or chaplets. The compressive forces are such that the substrate is able to be retained substantially in that condition during casting of the cladding.

The use of longitudinal strips or of chaplets in a central region of the substrate, to achieve such somewhat flattened condition, results in edges of the substrate being urged downwardly in the drag section cavity. Due to this, molten alloy for forming the cladding can be substantially prevented from flowing under the substrate. However, it can be beneficial to positively hold down the substrate at longitudinal side edges. For this latter purpose, a respective longitudinal refractory bar, for each of those edges of the substrate, may be molded into the cope section of the mold at a location at which it engages and holds down an edge of the substrate when the drag and cope sections are clamped together. Alternatively, where the sand of the cope section has sufficient strength, it can overlap and hold longitudinal edges of the substrate when the drag and cope sections are clamped together.

Where the mold sections abut at opposed peripheral surfaces as they are clamped together, the area of contact is sufficient to enable the sand of the mold sections to withstand the clamping force. Also, an area of cope sand directly over each lateral edge of the substrate, such as by 25 to 30 mm, can withstand compressive forces exerted on it by the bending forces generated in the substrate edges due to thermal stresses. However, at longitudinal strips or at chaplets used to flatten the substrate, the compressive forces per unit area can reach a level at which damage to the sand of the cope section can occur. To avoid this, the cope section can include ceramic pins, ceramic-tipped metal pins, longitudinal refractory bars or the like which transfer the compressive forces to the strips or chaplets. The pins, bars or the like may be fixed to or engaged with the support frame of the cope section, such that the compressive forces are transferred from the cope section support frame, to the substrate, via the pins, bars or the like and via the strips or chaplets.

Immediately adjacent to the gates, there can be difficulty in holding down the adjacent lateral edge of the substrate. Consequently, there is a risk of that edge of the substrate lifting during casting, and molten metal penetrating under the substrate. This risk is high due to thermal gradients from the upper to the lower surface of the substrate, caused by the superheated molten metal and its fast flow rate and the resulting bending forces in the substrate. However, if chaplets are used to hold down the lateral edge of the substrate adjacent to the gates they are likely to be dissolved rapidly by the fast flowing molten metal unless they are of a sufficient size and/or placed outside the direct metal stream emanating from the gates. A similar situation can occur if, rather than use of chaplets, longitudinal metal strips are used to hold down the substrate unless the strips are positioned out of direct alignment with any of the gates so that little or no turbulence is created in the metal flow and there is little chance of the strips dissolving too quickly. Accordingly, an alternative way is desirable to offset deformation or buckling of the substrate resulting in lifting of its lateral edge adjacent to the gates.

One suitable way in which to restrain lifting of the lateral edge of the substrate is to bend the substrate so as to cause the lateral edge to be forced down onto the drag mold sand. Another suitable way to restrain the lateral edge is to weld a strip of steel to the underside of substrate along that edge. A suitable strip, such as of mild steel, may for example be about 25×6 mm in cross-section and welded on edge for a substrate of about 10 mm thick. The strip is accommodated in a correspondingly positioned lateral groove in the drag section at which the depth of the drag section cavity is increased. During casting, location of the strip in that groove prevents penetration of molten alloy beneath the edge of the substrate.

For use in the present invention, there may be a casting station providing solid support for the drag section of the mold, means for convenient manipulation of a preheat furnace, and means for accurate placement and clamping of the cope section in relation to the drag section on completion of a preheat cycle for a substrate. At the casting station, there may be a support structure mounted on a solid support surface, with the drag section resting on or secured to the support structure by its frame. Adjacent to the support structure, there is means for pouring molten alloy for casting the cladding. This may be a ladle into which the alloy is received from a nearby furnace. However, it is preferred that the furnace is adjacent to the support structure and is adapted for pouring the molten alloy into the mold. The furnace may for example be an induction tilt furnace.

The cope section of the mold may be supported or mounted so as to be able to be raised from and lowered to a position in which it is able to be clamped to the drag section, as required. This movement of the cope section may be by any suitable device, such as by an overhead hoist, extendible hydraulic actuators or the like. The frame of the cope section preferably is provided with rollers which ride on posts of the support structure and thereby guide the cope section in its movement.

In its raised position, the cope section may be spaced above the drag section sufficiently to enable the preheat furnace to be positioned therebetween. The support structure may include horizontally disposed rails along which a carriage, which forms part of or supports the preheat furnace, is able to travel between a retracted position, and an advanced position in which the preheat furnace is above the drag section.

The preheat furnace can take a variety of forms, such as a gas burning preheater, an induction preheater or an electric element preheater. For trials with 10 mm thick substrates about 1950 mm long and 1050 mm wide, one form of suitable preheat furnace had a downwardly open stainless steel shell with 125 mm thick low heat capacity insulation to the internal top and side surfaces, and helical nichrome alloy wire elements supported by ceramic tubes. This furnace was connected to a three phase 415V control box and had a maximum power output of 150 kW.

BRIEF DESCRIPTION OF THE DRAWINGS

In order that the invention may more readily be understood, description now is directed to the accompanying drawings, in which.

DETAILED DESCRIPTION OF THE INVENTION

Figure 1:
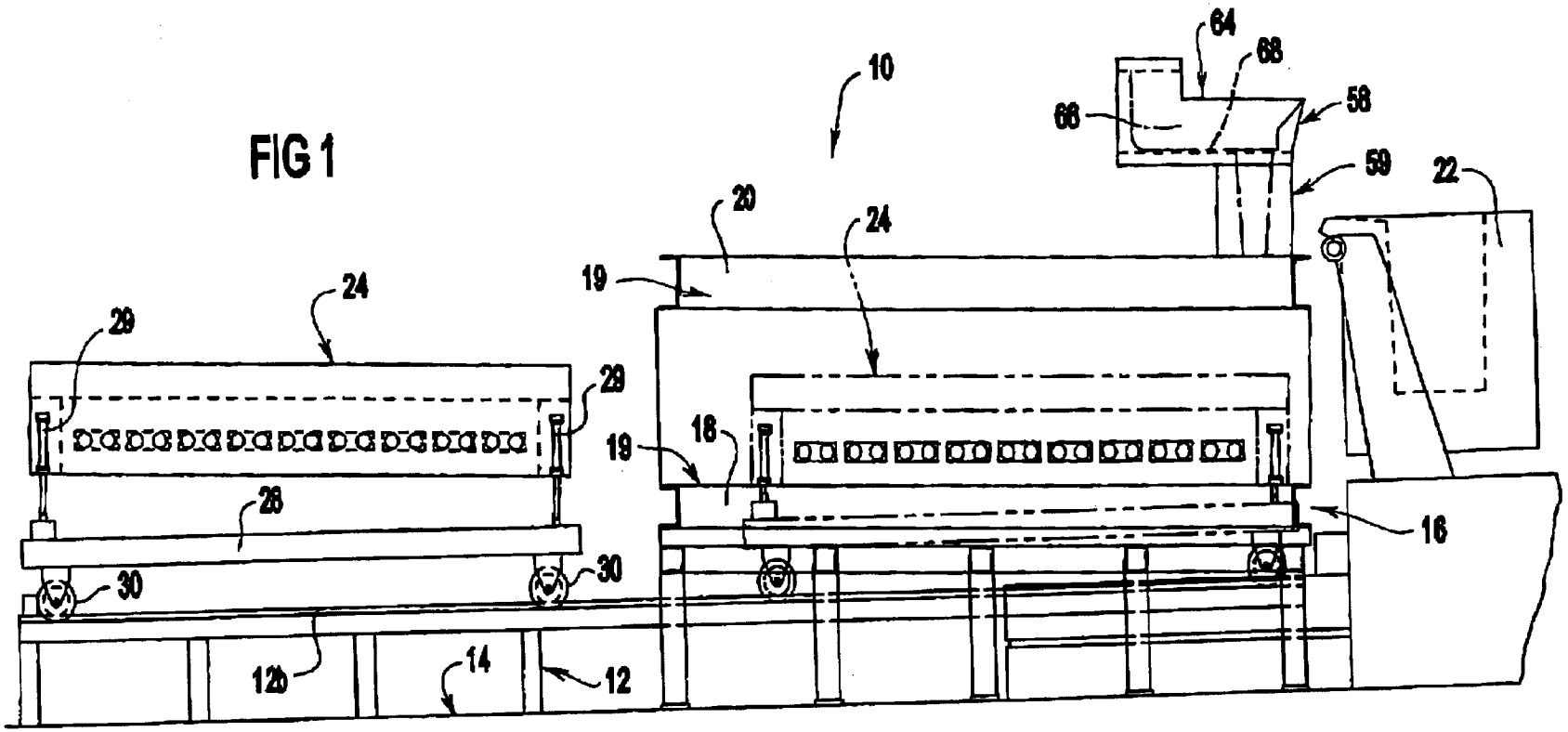
FIG. 1 is a schematic side elevation of a casting installation used in trials in accordance with the present invention.
Figure 2:
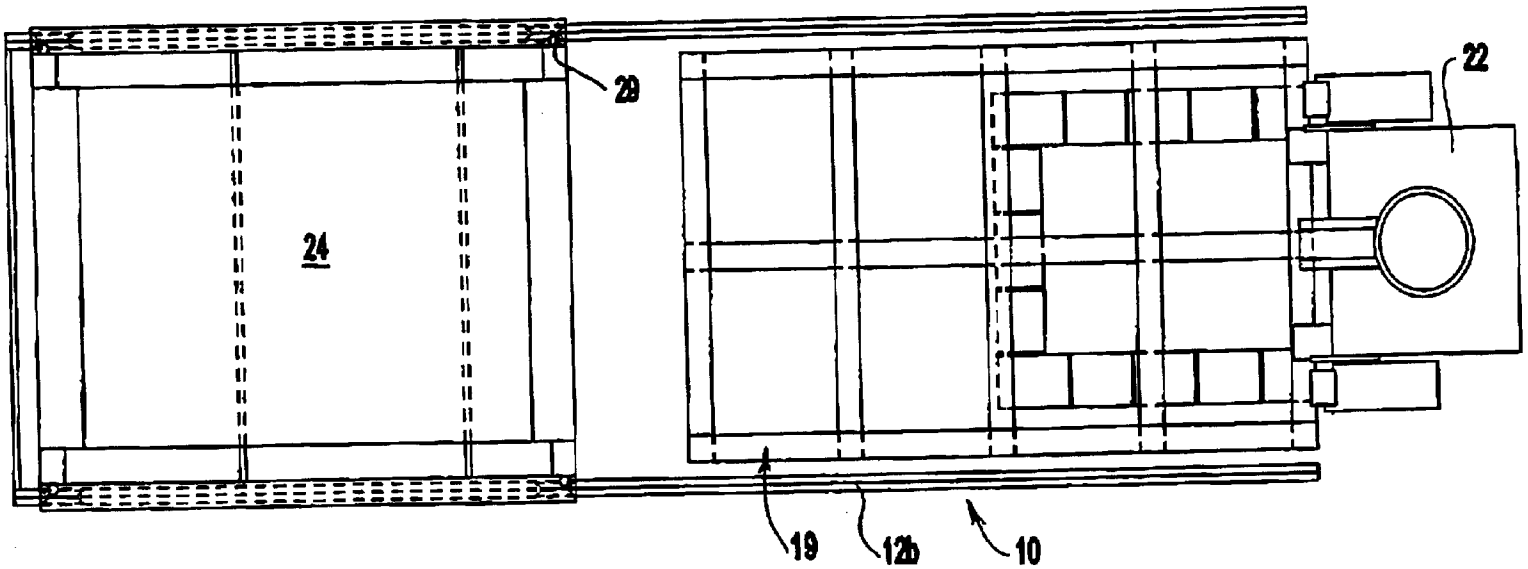
FIG. 2 is a top plan view of the installation of FIG. 1.

With reference to FIG. 1, the casting installation 10 has a support structure 12 formed of welded steel members and bolted in a concrete base 14. At a casting station 16, structure 12 has secured therein the drag section 18 of a mold 19. Above station 16, structure 12 also is engaged by the cope section 20 of the mold 19, while adjacent structure 12 at station 16 installation 10 includes a melt furnace 22. Drag section 18 rests on structure 12 at a fixed location. However, the cope section 20 is supported by the chain system (not shown) of an overhead crane (also not shown), such that cope section 20 can be moved between the elevated position shown in FIG. 1, and a lower position in which it can be clamped to drag section 18 to close the mold 19 for a casting operation. In its movement, cope section 20 is guided by being provided with rollers (not shown) which run on guide rails sections of posts (also not shown) of structure 12.

Installation 10 also includes a preheat furnace 24 which is adjustably mounted on support structure 12. For this mounting, structure 12 has a laterally spaced pair of longitudinal rails 12*b* which extend from each side of drag section 18, beyond the latter in a direction away from melt furnace 22. The preheat furnace 24 is mounted on a carriage 28 by means of hydraulic actuators 29, with carriage 28 having rollers 30 by which it runs on rails 12*b*, such that furnace 24 is movable from the retracted position shown in solid line in FIG. 1 to a position shown in broken outline in FIG. 1 in which it is between mold sections 18 and 20, closely positioned over drag section 18 (assuming that cope section 20 is in its elevated position).

Figure 3:
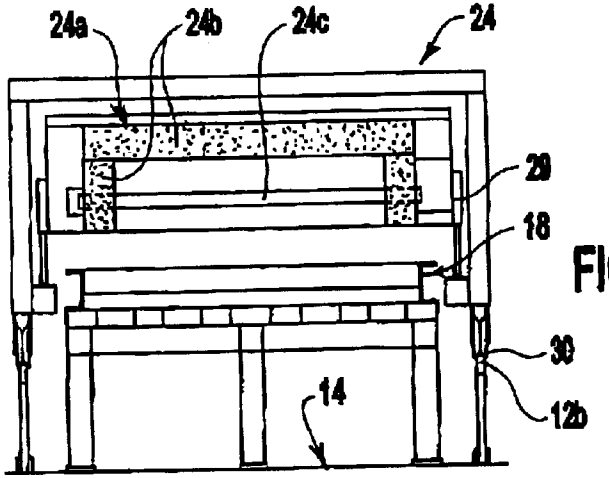
FIG. 3 is a part end elevation/sectional view of the installation of FIG. 1.

As shown most clearly in FIG. 3, the preheat furnace 24 has a housing 24*a* in the form of an inverted trough which therefore is downwardly open. The housing preferably is of stainless steel and has lateral and longitudinal extents greater than that of the substrate S (see FIGS. 12 to 14). The interior surfaces of housing 24*a* are lined with low heat capacity insulation 24*b*, while a longitudinal array of laterally extending resistance heating elements 24*c* is mounted in housing 24*a*. The elements 24*c* may, for example, comprise helical nichrome alloy wires supported on ceramic tubes and adapted to be heated by power from a suitable electric power source (not shown).

Figure 12:
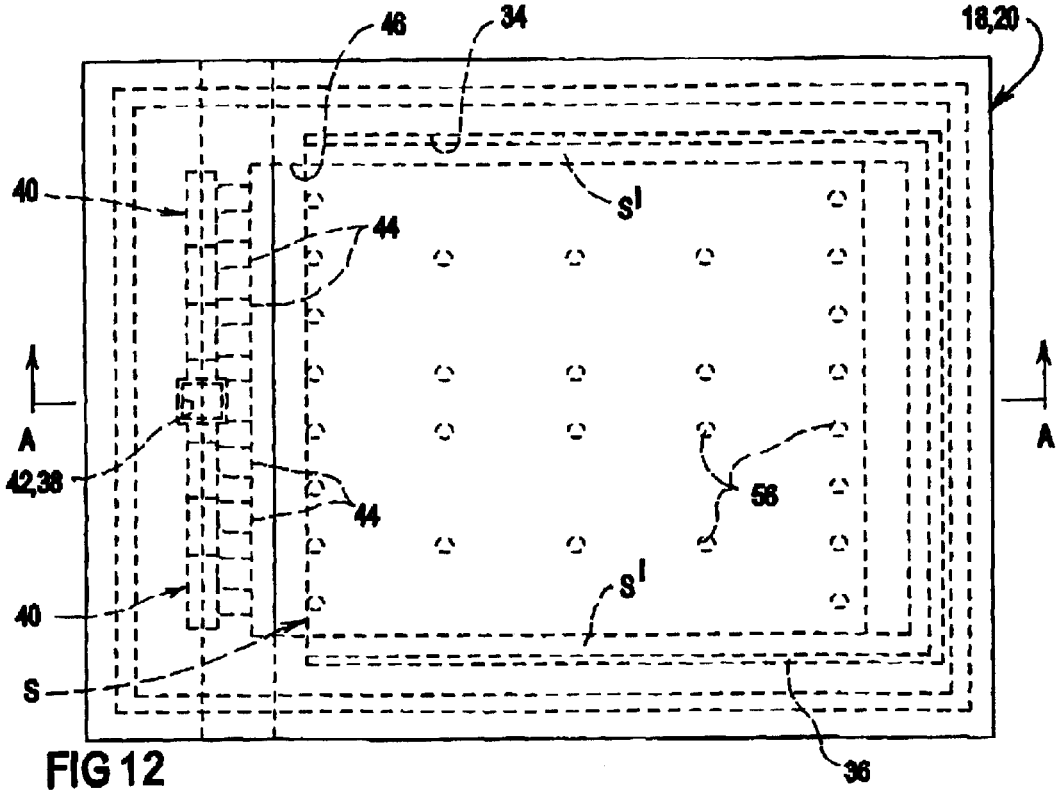
FIG. 12 is a schematic plan view of a general form of mold for the installation of FIG. 1.
Figure 13:
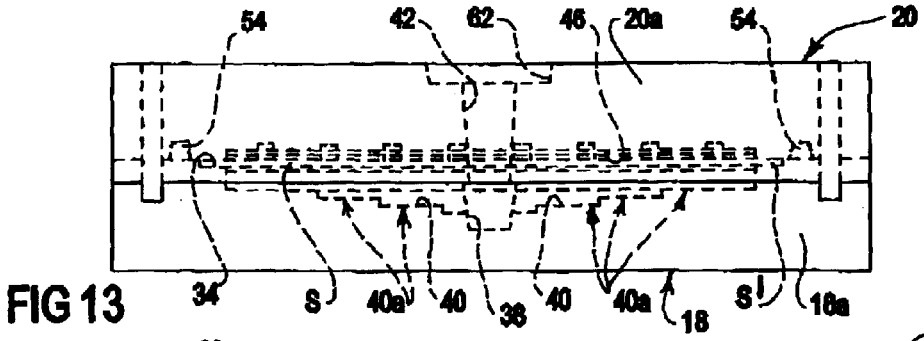
FIG. 13 is an end elevation of the mold of FIG. 12.
Figure 14:
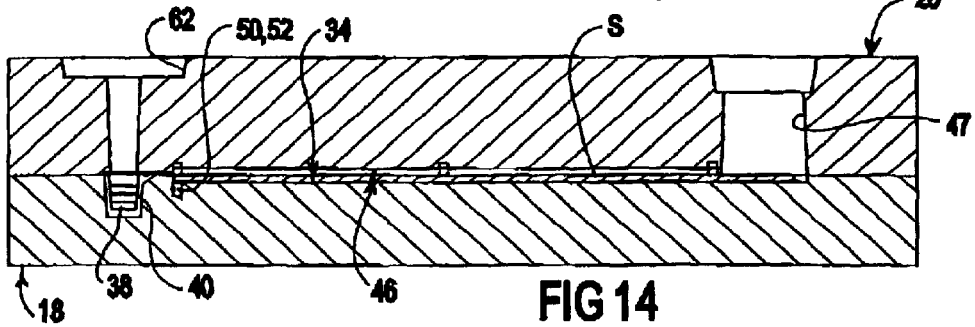
FIG. 14 is a sectional view taken on line A—A of FIG. 12.

The mold has respective sand mold parts 18*a* and 20*a*, of the drag and cope sections 18 and 20, as shown in FIGS. 12 to 14. The parts 18*a* and 20*a* are formed in a welded steel drag support frame 18*b* (see FIGS. 6 to 8) and welded steel cope support frame 20*b* (see FIGS. 9 to 11), respectively. As seen most clearly in FIGS. 12 to 14, the drag mold part 18*a* has a large rectangular cavity 34 in which a substrate S is positionable. Cavity 34 has a depth corresponding to the substrate thickness, and longitudinal and lateral dimensions sufficient to accommodate the substrate S and provide a clearance 36 allowing for thermal expansion of substrate S.

Figure 15:
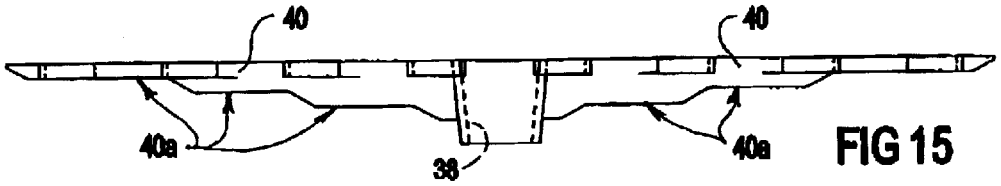
FIG. 15 is a schematic end representation of the runner and gate system of the mold of the installation of FIG. 1.
Figure 16:
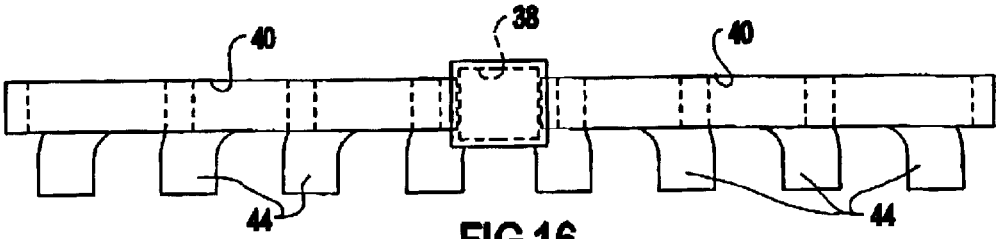
FIG. 16 is a schematic plan representation of the system of FIG. 15.

At the end nearer to furnace 22, and adjacent to an end of cavity 34, drag mold part 18*a* has a sprue well 38 and, to each side of well 38, a respective lateral runner 40 (shown also in FIGS. 15 and 16). At the same end of cope mold part 20*a*, there is a bottom feed sprue part 42 which has an enlarged upper end 62 and which is vertically aligned with sprue well 38 and, to each side of sprue 42, there are four gates 44. Part 20*a* also has a large rectangular cavity 46 which has a depth which may be similar to that of cavity 34, depending on the required cladding thickness for substrate S. However, cavity 46 is of less lateral width than cavity 34 and, at its end nearer to furnace 22, cavity 46 extends beyond cavity 34 form a galley portion and to achieve communication with each gate 44. At the other end of cavity 46, part 20*a* has an enlarged overflow damping cavity 47 which is over the end of substrate S.

The drag section 18 of the mold is mounted or rests on support structure 12 such that its upper surface and, hence, substrate S is at a small angle to the horizontal. That is, while the upper surface of the substrate is substantially horizontal, it is inclined slightly to the horizontal. Specifically, as is evident in FIG. 1 the arrangement is such that substrate S is inclined upwardly from its end adjacent to furnace 22 to its remote end at an angle of a few degrees, such as up to about 5°, for example, about 3°. The cope section 20 may be similarly inclined or, alternatively, it may be substantially horizontal but adjustable when lowered onto section 18 so as to become similarly inclined, thereby facilitating closing of the mold. Also, the actuators 29 which support furnace 24 above carriage 28 are able to hold furnace 24 at an angle to the horizontal such that furnace 24 is substantially parallel to substrate S, while actuators 29 can enable variation in the height of furnace 24 above carriage 28, as may be required, such as to lower furnace 24 to a required spacing above substrate S.

Figures 6, 7, 8:
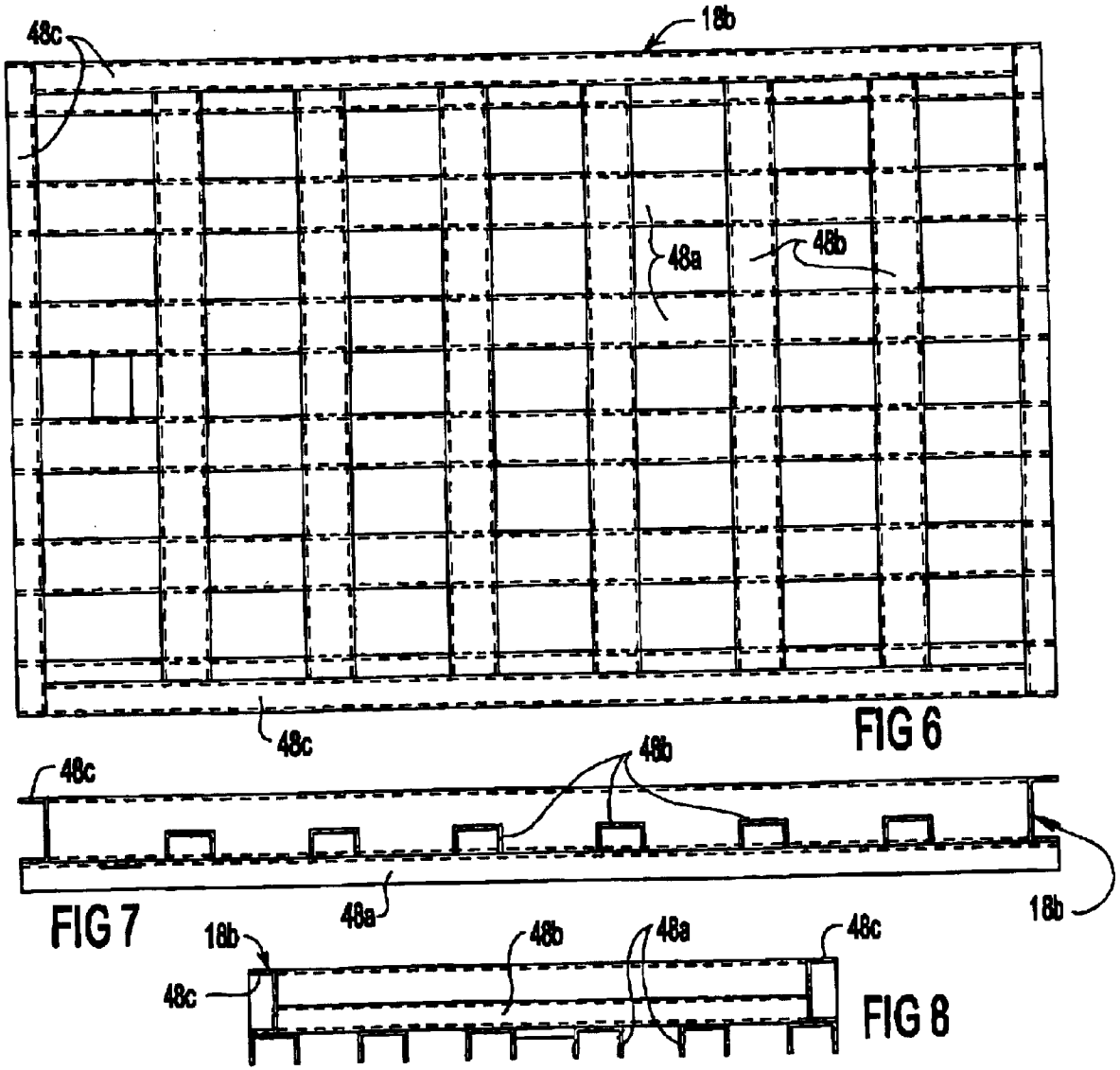
FIG. 6 is a plan view of a drag mold frame of the installation of FIG. 1.
FIG. 7 is a side elevation of the frame of FIG. 6.
FIG. 8 is an end elevation of the frame of FIG. 6.

As indicated above, the sand mold parts 18*a* and 20*a*, of drag and cope sections 18 and 20 of mold 19, are formed on respective welded steel frames 18*b* and 20*b*. As shown in FIGS. 6 to 8, frame 18*b* has a lower series of laterally spaced, longitudinally extending C-section channels 48*a* having their webs uppermost. On the channels 48*a*, frame 18*b* has an upper series of longitudinally spaced, laterally extending C-section channels 48*b* which also have their webs uppermost. Around the rectangular grid formed by channels 48*a* and 48*b*, frame 18*b* has a rectangular perimeter provided by C-section channels 48*c*. The channels are securely welded together at junctions therebetween, while the upper flange of each channel 48*c* has openings formed therein, at intervals along its length.

Figures 9, 10, 11:
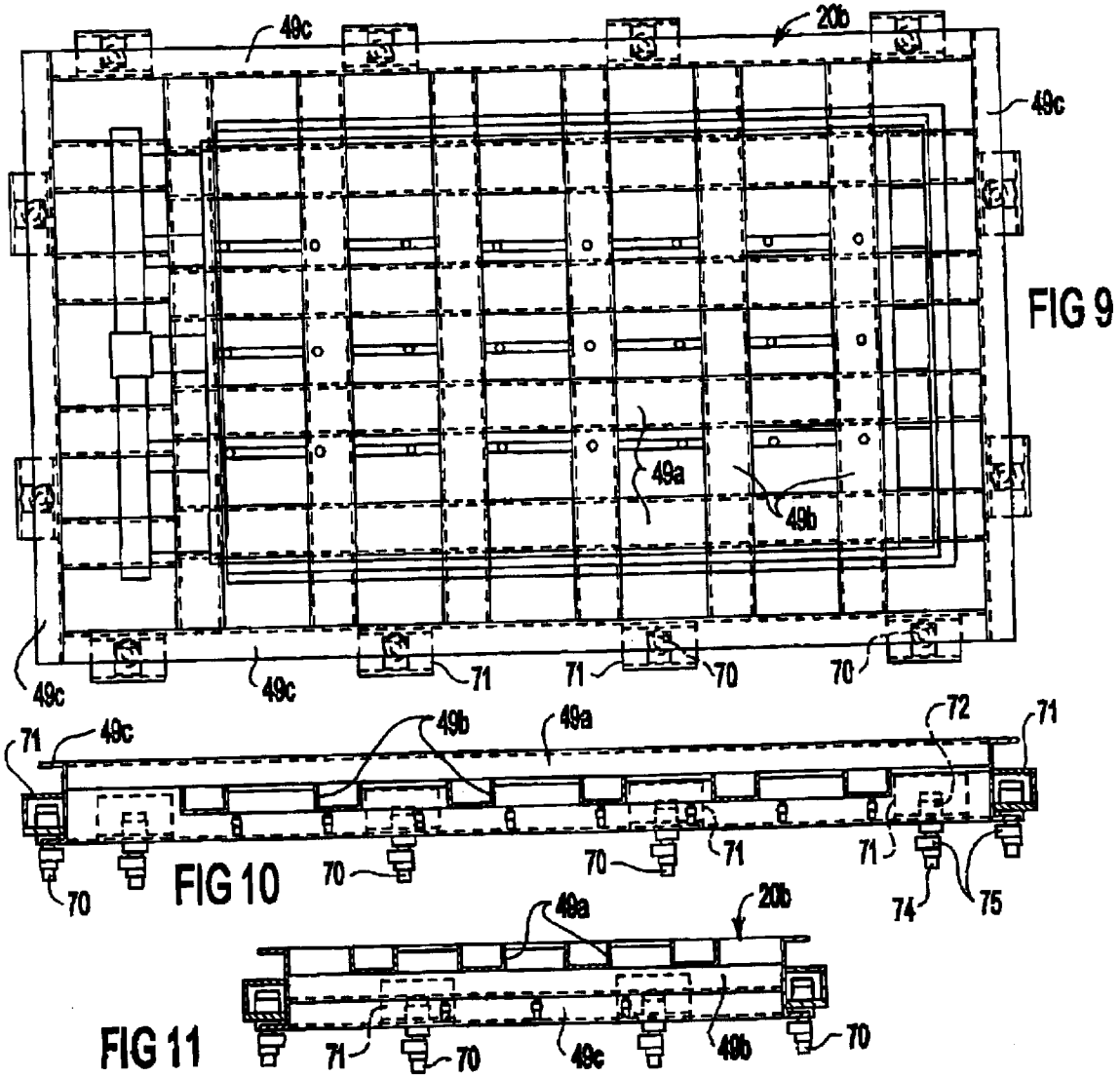
FIGS. 9 to 11 are similar to FIGS. 6 to 8 but show a cope frame.

As shown in FIGS. 9 to 11, cope frame 20*b* is somewhat similar to drag frame 18*b*, with upper channels 49*a* and lower channels 49*b* corresponding to channels 48*a* and 48*b*, respectively and peripheral channels 49*c* corresponding to channels 48*c*.

As indicated, drag and cope sections 18 and 20 need to be strongly clamped together on closing the mold, to seal the interface between sections 18 and 20 against molten alloy leakage, while clamping needs to be achieved quickly to minimize neat loss. For this, clamping devices of a number of forms can be used. However, the preferred form is that of device 70 shown in FIG. 9, with there being a respective device 70 at each of a number of locations around the periphery of the mold. Each device is mounted on a respective bracket 71 welded at intervals along each channel 49*c* of frame 20*b*. Each device 70 comprises a hydraulic swing clamp, such as type SU(L/R)S 201 available under the trade mark ENERPAC, providing about 18.8 kN clamping force at about 35 MPa oil pressure. These devices have a cylinder body 72 mounted on the support frame 20*b* of cope section 20, and a depending piston rod 74 extending from body 72. Hydraulic pressure lines (not shown) supply oil to body 72 to enable rod 74 to be extended and retracted relative to body 72. Engagement between rod 74 and its body 72 is such that rod 74 rotates in one or other direction as it is extended or retracted.

Below each device 70, the support frame 18*b* of drag section 20 has a respective one of the above-mentioned openings (not shown) cut-out from the upper flange of a respective channel 48*c*. The size of each opening is such that, as cope section 20 is lowered onto drag section 18 with rod 74 extended, the rod 74 and an eccentric collar 75 secured on rod 74 passes through the opening. The rod 74 then is able to be retracted and, in simultaneously rotating, its collar 75 is engaged below the flange from which opening is cut-out. Thus, the drag and cope sections 18 and 20 are able to be strongly clamped together, under the simultaneous action of several devices 70.

When the mold is closed, it is required that parts 18 and 20 be clamped together, to achieve a seal between opposed surfaces around cavities 34 and 46 which substantially prevents the leakage of molten metal therebetween. The clamping preferably is able to achieve this by sand-to-sand surface contact between mold sections 18 and 20, without the need for application of a sealing aid.

With mold section 20 raised, substrate S is positioned in cavity 34. Prior to this, at least the upper surface of substrate S is treated, to remove all oxide. This may, for example, be by sand, grit or shot blasting, use of a wheel or belt abrader or by pickling. When the cleaned substrate S has been positioned in cavity 34, its upper surface is protected by a flux coating, such as provided by flux comprising a flux powder, a liquid flux or a flux powder in a liquid suspension. The flux is to substantially prevent re-oxidation of substrate S and, if required, other means detailed herein can be used instead of flux. The preheat furnace 24 then is moved along rails 12*b* to its position over drag section 18 for heating of substrate S to a sufficient preheat temperature.

The preheat furnace 24, as will be appreciated, is to apply heat energy to raise the temperature of the substrate S to a level sufficient, in combination with superheating of the molten alloy in melt furnace 22, to achieve required bonding with cast cladding alloy. While furnace 24 preferably is an electric element heater such as described above, it could be a gas heating or induction furnace Before detailing a cycle for casting cladding, it will be appreciated that preheating of substrate S by furnace 24, such as to about 750° C., will result in thermal stresses in substrate S and its resultant deformation. Also, casting molten alloy onto substrate S, by pouring alloy into a mold cavity comprising cavities 34 and 46, increases the thermal stresses and deformation. In the arrangement as generally described to this stage, the deformation would substantially preclude the production of a useful bimetallic product. A number of further features need to be utilized, in combination with the inclination of the drag section 18 and substrate S, and the disposition of runners 40 and gates 44, in order to produce such product.

As shown, the base 40*a* of each runner 40 is stepped upwardly after each gate 44, such that the cross-section of each runner 40 decreases laterally of sprue well 38. Particularly under the pouring conditions detailed below, the form of each runner is such that substantially the same pressure and flow-rate of molten metal passes to and through each gate 44. The resultant separate streams of molten metal passing through gates 44 very quickly form into a single stream and tend not to give rise to non-uniform longitudinal flow of molten metal along substrate S. Avoidance of such non-uniform flow also is facilitated by the inclination of substrate S, since the flow of molten metal along the substrate is against the action of gravity. Rather, there is generated a melt front which preferably is substantially uniform laterally of substrate S and which moves substantially in that form longitudinally along and up the slight inclination of substrate S.

To offset the effect of thermal stresses at the lateral edge of substrate S nearer to furnace 22, a steel strip 50, such as about 25×6 mm in cross-section, is welded on edge across the lower surface of substrate S, at that edge. A corresponding lateral channel 52 is formed in drag mold part 18*a*, at the corresponding end of cavity 34 such that, with substrate S positioned in cavity 34, strip 50 is neatly accommodated in channel 52. Deformation of substrate S immediately adjacent gates 44 is substantially prevented by the provision of strip 50 with leakage of molten alloy under substrate S at that edge substantially being prevented. Leakage is further restrained by provision of a ceramic fiber seal or the like in channel 52, below strip 50. Also, a layer of ceramic fiber paper may be provided in cavity 34 below substantially the full area of substrate S if the preheat furnace capacity is low, as such insulation under the substrate can assist in reducing the time required for preheating substrate S.

As will be appreciated, the provision of strip 50 is but one suitable arrangement for preventing deformation or buckling of substrate S at its lateral edge nearer to furnace 22. As detailed above, alternatives for achieving that end include the use of chaplets or longitudinal strips on the upper surface of substrate S, or threaded metal studs welded to the underside of substrate S. Alternatively, use can be made of appropriate mold design enabling the lateral edge of substrate S to be forced onto the drag mold by the sand of the cope mold.

As indicated above, cavity 46 in cope mold part 20*a* is of lesser lateral extent than cavity 34 in drag mold part 18*a*. The extent of this difference is greater than thermal expansion clearance 36 and, as a consequence, longitudinal margins S' of substrate S are engaged by overlapping areas of cope mold part 20*a* when the mold is closed. At least for a major part of this overlap, part 20*a* may be provided with a refractory ceramic insert strip 54. The arrangement of the strips 54 is such that with the drag and cope sections clamped together, each strip 54 is forced downwardly on a respective substrate margin S'. The force necessary for closing the mold to seal against leakage of molten metal is sufficient to cause strips 54 to hold margins S' substantially flat and thereby prevent significant leakage of molten metal under substrate S via those margins. However, ceramic strips 54 need not be provided, as their function can be obtained with cope sand overlapping margins S' where the strength of the cope sand is sufficient to hold margins S' substantially flat.

Controlling deformation of substrate S so as to prevent leakage of molten metal under its edges is important in achieving production of a useful bimetallic plate. However, a good degree of uniformity of thickness for the cladding also is important, particularly in the central region of the substrate where upward bowing of the substrate often is severe. To at least reduce such deformation of the central region, suitable spacing means of a suitable alloy are provided over the upper surface of the substrate, and retained such as by tack welding. In the arrangement shown, the means comprises an array of circular chaplets or discs 56 each having a thickness corresponding to that required for the cladding. On clamping the drag and cope sections together, compressive forces on discs 56 act to press substrate down into cavity 34 so that the substrate assumes a somewhat flat condition. Upward bowing of substrate S can still occur between successive discs 56, but this is relatively minor and its extent can be controlled by the spacing between discs 56. As shown, discs 56 can be used over the central region of substrate S, as well as along its lateral edge remote from furnace 22.

For forming cast cladding on preheated substrate S, to produce a bimetallic plate, molten alloy at a suitable superheated temperature is poured from furnace 22 into the mold, to fill cavity 46. It is highly desirable that cavity 46 be filled quickly. This is to ensure an overall heat energy balance, resulting from preheating substrate S and the superheating of the molten alloy, is maintained at a suitable level until filling of cavity 46 has been completed, to thereby obtain required bonding between the cladding and substrate S over substantially the entire interface therebetween. To enable rapid filling of cavity 46, a pouring basin is mounted on cope section 20.

In FIG. 1, there is shown a pouring basin 58 used for initial trials in producing bimetallic plate of about 600×600 mm with a substrate and cladding thickness each of 10 mm. Basin 58 is mounted in relation to cope section 20 by means of an upper feed sprue part 59 which provides communication between the interior of basin 58 and bottom feed sprue part 42 of cope section 20. Basin 58 and upper sprue part 59 are raised and lowered with cope section 20. With section 20 lowered onto and clamped to drag section 18, basin 58 is positioned for receiving molten alloy from melt furnace 22, as the latter is titled forwardly, i.e. over basin 58.

Figure 4:
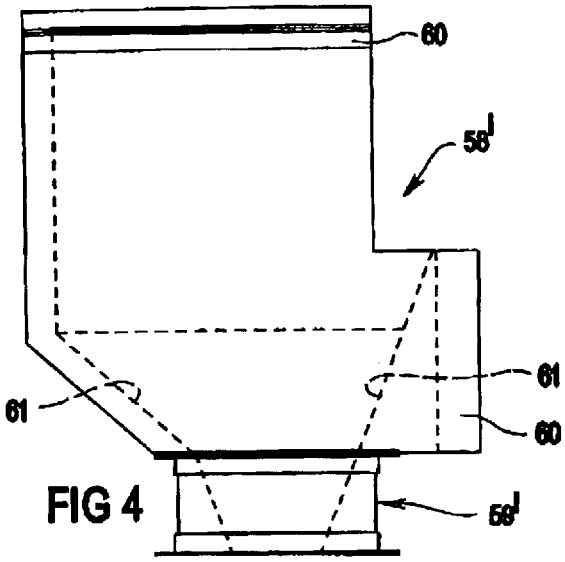
FIG. 4 is a side elevation of an alternative component of the installation of FIG. 1.
Figure 5:
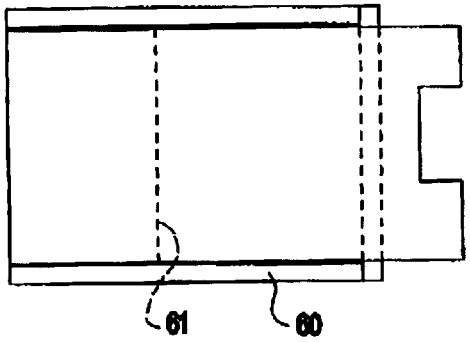
FIG. 5 is a plan view of the alternative component of FIG. 4.

Operation with basin 58 and sprue part 59 generally is satisfactory for producing bimetallic plate up to about 600×600 mm in size. However, for such plate, it was found desirable to adopt an arrangement as shown in FIGS. 4 and 5, with that arrangement being necessary for plate of larger sizes. The arrangement of FIGS. 4 and 5 includes a pouring basin 58' and in upper feed sprue part 59'. The important differences between basin 58' and sprue part 59' of FIGS. 4 and 5 and basin 58 and part 59 of FIG. 1 are:

(i) a reduction in the height of part 59' and a corresponding increase in the height and internal volume of basin 58';

(ii) the more central location of the outlet of basin 58' to sprue part 59'; and (iii) the provision of a top on basin 58', such that with furnace 22 tilted to pour molten alloy into basin 58', the latter is substantially closed around the spout of furnace 22.

As a consequence of these differences, it is possible to essentially dump into basin 58' substantially the full quantity of molten alloy required for the cast cladding for a bimetallic plate of a suitable size. Also, molten alloy is able to flow from basin into mold 19, via sprue part 59', at a higher flow rate due in large part to the more direct through-flow possible with basin 58'. Thus, a melt front of molten alloy formed on the substrate S in the mold 19 is able to advance across substrate S at a higher rate, enabling completion of casting within a period of time in which a heat energy balance consistent with uniform bonding can be maintained.

As will be appreciated, dumping of molten alloy into basin 58' enables a melt front to be quickly generated in mold 19. Also, the melt front is able to commence quickly to advance across substrate S. Thus, minimum time and, hence, minimum heat energy, is lost between commencing pouring and initiating a suitable flow of molten alloy across substrate S. This benefit combines with other factors enabled by installation 10, in that, after preheating substrate S by furnace 24, the latter can be retracted quickly along rails 12*b*, and cope section 20 then is able to be lowered and clamped to drag section with minimum delay. Thus, from completion of preheating through to completion of casting, loss of heat energy is able to be minimized.

As shown in FIGS. 4 and 5, the pouring basin 58' is of rectangular block form. It has an outer shell 60 of steel plate and an internal refractory liner 61. In its lower half, the internal surfaces of liner 61 converge to an outlet which leads to sprue part 59', basin 58' having an interior somewhat similar to a hopper of rectangular section.

The furnace 22 is an induction furnace for melting cladding alloy, and is tiltable to enable its molten alloy charge to be poured into basin 58'. In use, the molten charge is dumped into basin 58' such that the pressure head of molten alloy held therein provides a steady, but strong, driving force for filling cavity 46. In the case of the FIG. 1 arrangement, basin 58 has an open top 64 of elongate rectangular form to define a chamber 66 which is between sprue part 42 and furnace 22 and is separated from sprue part 59 by a lateral ridge 68. The melt is poured, rather than dumped, and enters basin 58 at its chamber 66, while ridge 68 acts to prevent undue turbulence in the melt as it flows to fill sprue parts 59 and 42 and as its level rises above ridge 68 in basin 58.

Figure 17:
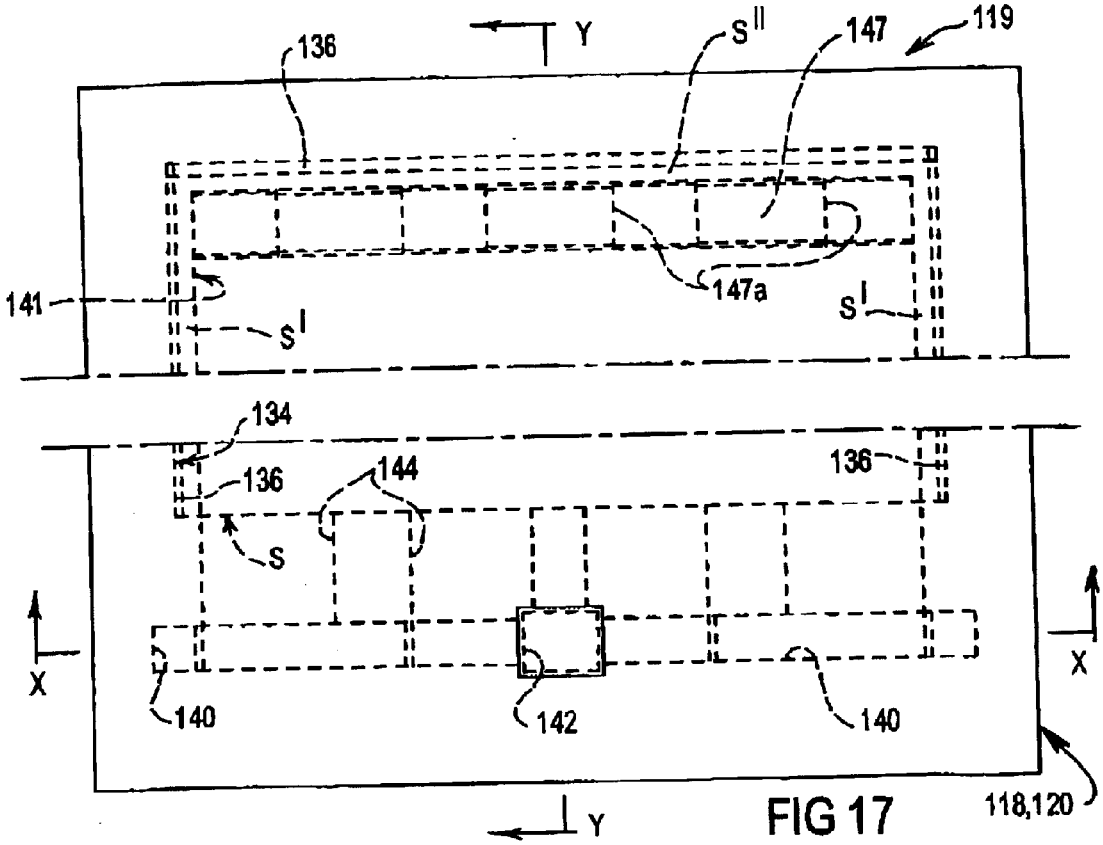
FIG. 17 corresponds to FIG. 12, but shows detail of a mold used in trials with the installation of FIG. 1.
Figure 18:
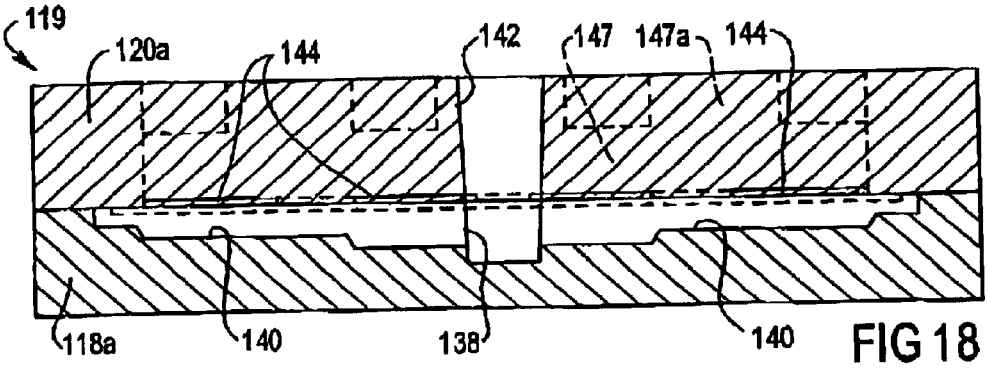
FIG. 18 is a sectional view on line X—X of FIG. 17.
Figure 19:
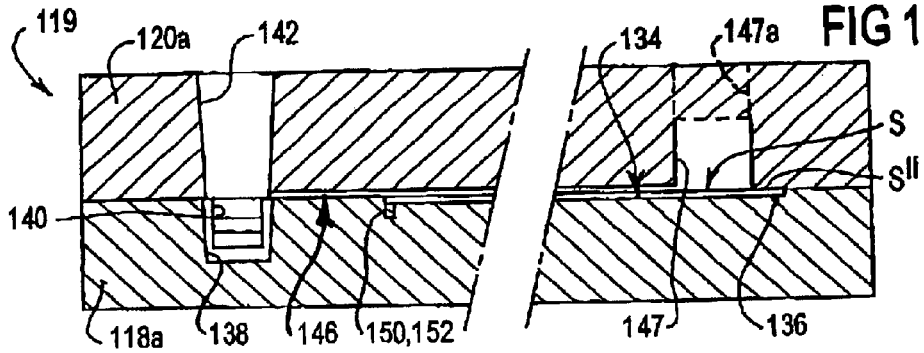
FIG. 19 is a sectional view on line Y—Y of FIG. 17.

In FIGS. 17 to 19, there is shown detail of a mold 119 used in trials, with the installation of FIG. 1, producing bimetallic plate of 1800×1000×10 mm on 10 mm, i.e. plate 1800×1000 mm in area having 10 mm of cast cladding bonded to a 10 mm thick substrate. In FIGS. 17 to 19, components corresponding to those of FIGS. 12 to 14 have the same reference numerals plus 100. However, description is essentially limited to matters by which mold 119 differs from mold 19 of FIGS. 12 to 14.

Mold 119 has a drag section part 118*a* and a cope section part 120*a* of bonded sand. While not shown in FIGS. 17 to 19, each part 118*a* and 120*a* is formed in a respective steel support frame as shown in FIGS. 6 to 8 in the case of part 118*a* and FIGS. 9 to 11 in the case of part 120*a*.

The cavity 134 in mold part 118*a* has a lateral dimension of about 1120 mm which is about 20 mm greater than the initial lateral dimension of substrate S, to leave an expansion clearance 136 at each side of substrate S of about 10 mm. Similarly, while substrate S has an initial longitudinal extent of about 1950 mm, that of cavity 134 is about 1970 mm so that a clearance 136 of about 20 mm is provided at the end of substrate S remote from furnace 22 (FIG. 1) and bottom feed sprue part 142. Again, parts 118*a* and 120*a* are clamped together to achieve a seal by sand to sand contact therebetween. For this, and to prevent substrate S from lifting at its edges, the lateral width of cavity 146 of cope part 120*a* is about 1050 mm, so that respective side margins S' of substrate S, which initially are of about 25 mm wide, are held down by overlapping surface areas 141 of cope part 120*a*. Also, rather than provide chaplets along the end of substrate S remote from furnace 22, an end margin S" of substrate S is similarly held down by an overlapping surface area of cope part 120*a*. Margin S", also initially about 25 mm wide, results from the longitudinal extent of cavity 146 being about 1925 mm, compared with about 1950 for the initial extent of substrate S (and, allowing for end clearance 136, compared with a longitudinal extent of about 1970 mm for cavity 134 in drag part 118*a*.)

As seen in FIGS. 17 to 18, there are two gates 144 to each side of sprue 142 by which molten alloy is able to flow from each runner 140. Again, each runner 140 is progressively reduced in depth after each gate 144 so as to substantially equalize the melt pressure and flow rate through each gate 144.

At the end of mold 119 remote from furnace 22, cope part 120*a* again defines an overflow damping cavity 147 which is over the corresponding end of substrate S. However, a comparison of FIGS. 14 and 19 shows a difference between respective molds 19 and 119. In mold 19, cavity 47 is positioned such that it straddles the end edge of substrate S. In contrast, in mold 119, cavity 147 is above substrate S and is spaced from that edge by margin S". In FIG. 14, cavity 47 is shown simply as a downwardly open lateral channel in cope part 120*a*, although venting through part 20*a* is desirable. In FIG. 19, cavity 147 again is shown as a downwardly open, lateral channel, such as about 115×115 mm in the sectional view of FIG. 19, although cavity 147 opens through cope part 120*a* by provision of three vents 147*a* along its length.

As indicated, mold 119 holds substrate S down at two margins S' and at a further margin S". As also shown, the lateral edge of substrate S adjacent to furnace 22 and sprue 142 is provided with a lateral strip 150 which is located in a lateral channel 152 formed in drag part 118*a*. While not shown, means need to be provided to prevent deformation of substrate S inwardly of its edges, and such means can comprise alloy strips or chaplets as detailed above.

Trials have been conducted with an installation as in FIG. 1, using a mold as in FIGS. 17 to 19 which incorporated a support frame as in FIGS. 6 to 8 and a support frame as in FIGS. 9 to 11. In these trials, the mold was arranged so that it was inclined upwardly from furnace 22 at an angle of about 3°. The substrates, each comprising 10 mm thick wrought 250 grade, low carbon steel plate initially, were 1050 mm wide and 1950 mm long. The alloy used for forming the cladding, to a thickness of 10 mm on each substrate, was a 15/3 Cr—Mo high chromium white iron of near eutectic composition, suited for forming a wear-resistant overlay material.

The substrates were prepared by grit blasting the top surface of each, that is the surface with which the cladding was to be bonded. The blasted surface of each substrate, substantially free of oxide, then was painted with a suspension of a commercial copper and brass flux available from CIGWELD, to protect the substrate from oxidation during preheating and to promote formation of a diffusion bond. Also, the bottom surface of each substrate was painted with a zirconia-based mold wash to prevent bonding between the substrate and any cast alloy penetrating underneath the substrate.

Before the substrates were subjected to blast cleaning, a 25×6 mm steel strip was welded on edge to the bottom surface of each substrate, across its front edge, i.e. the lateral edge to be nearer to furnace 22. This was to reduce the risk molten alloy penetration below the substrates during casting.

Also, buckling control means were provided over the upper surface of each substrate. In the case of a first series of substrates, the control means comprised three 10×3 mm steel strips tack-welded on to the upper surface of each substrate, to form four distinct longitudinal channels of the same lateral width, along which cast molten alloy could flow. In a second series of substrates, such strips were not used; rather, the control means comprised for each substrate 24 discs of high chromium white cast iron chaplets, 25 mm in diameter and 10 mm thick, which were spot welded to the substrate in a uniform array. In each case, the control means was to ensure buckling of the substrate was restrained and such that it could not disturb the flow of molten alloy to an extent such that all of it would run over one area of the substrate without wetting another area.

For each trial, about 260 kg of hypereutectic high chromium white cast iron was melted in the induction tilt furnace and heated to between 1600° C. and 1650°C. This represents a superheat of about 350° C. The melt composition was adjusted as appropriate during the melting cycle and a final spectro sample was taken just prior to casting.

During the melting procedure a substrate was positioned in the mold drag section and preheated to a temperature of about 750° C. At this preheat temperature the flux is liquid, wets the substrate and greatly reduces oxidation, although the time that the substrate remains at that temperature before casting the white cast iron should be kept to a minimum. Since it is a physical impossibility to have a completely uniform temperature throughout the substrate during preheat, with the edges being cooler than the center of the substrate and the top surface being hotter than the bottom, the substrate will bow up and buckle somewhat. Therefore, the substrate is allowed to soak for about ten minutes after the preheat temperature has been reached, which allows the temperature to equalize somewhat and bowing is reduced. The preheat cycle is timed such that when the substrate is fully preheated, the liquid metal is at the correct superheat temperature and available for casting.

On completion of preheating, the preheat furnace is switched off, lifted and moved out of the way. The mold is closed by lowering the cope and hydraulically clamping the mold sections. The liquid metal is then immediately poured and caused to flow over the substrate. The whole operation of preheat furnace removal, mold closure and pouring needs to be relatively quick to minimize heat loss. The operation desirably takes less than one and a half minutes, such that the temperature drop in both the preheated substrate and in the melt are quite small. Pouring of the 260 kg of metal is done in only a few seconds to ensure a fast flow rate of the liquid metal over the substrate surface.

The requirements for maintenance of an overall heat energy balance and the rate of advance of the melt front across substrate S establish the distance across the substrate, in the direction of front advance, over which uniform bonding can be achievable. That distance, or bond length, can of course be greater than the dimension of substrate S in that direction. However, assuming that cladding is required over substantially the full upper surface of substrate S, the rate of melt front advance is to be such that a bond length at least equal to that dimension of the substrate S. In many instances, a rate of melt front advance of from about 0.3 m/s to about 1.0 m/s is found to be suitable. However, the rate of melt advance preferably is from about 0.4 ms to about 0.8 m/s.

For at least some practical applications, a rate of melt front advance less than about 0.3 m/s will be suitable if the dimension of the substrate in the direction of melt front advance is relatively small, such as about 300 mm. For substrates having a dimension in that direction which is larger, it generally is desirable to have a rate of melt front advance of at least about 0.3 m/s. In general, the rate increases with the dimension of the substrate in the direction of melt front advance, although the thickness of the cladding being cast and the ratio of that thickness to the substrate thickness are other factors influencing this. However, it usually is preferred to limit the rate of melt front advance to about 1.0 m/s as it can become difficult to maintain a uniformly advancing front at higher rates.

It is indicated earlier herein that the present invention enables the production of bimetallic plate up to and in excess of 1800 mm×1000 mm, such as 1800 mm to 1500 mm, possibly up to about 3000 mm×1500 mm, such as 3000 mm×1650 mm. At the other extreme, the plate most conveniently has a major surface area of at least about 0.84 $m^2$ (i.e. about 9 sq ft), such as with dimensions of about 900 mm×900 mm. That is, the present invention principally is applicable to the production of bimetallic plate which is at least about an order of magnitude, i.e. at least about 10 times, greater in area than the largest area for which the teaching of U.S. Pat. No. 4,953,612 to Sare et al is suitable.

Also, in contrast to U.S. Pat. No. 4,953,612 to Sare et al, the present invention is suitable for use with substrate of a thickness of about 16 mm or less, such as down to about 4 mm. Also, the thickness of cladding able to be cast on a substrate can be twice the substrate thickness, or less, with a maximum overlay thickness of about 25 mm (1 inch). Like the teaching of Sare et al, the invention enables a sharply defined, essentially planar interface between the substrate and cladding. However, in further contrast to the teaching of Sare et al, the invention enables production of large bimetallic plate with a cladding to substrate thickness of 2:1 or less, which facilitates consistent attainment of a high cooling rate in the cast metal throughout, substantially uniform composition and, hence, superior wear characteristics throughout the cladding layer.

After casting, the mold is left clamped for about 30 minutes to allow sufficient solidification in the runner and overflow cavities. The cope is then lifted off and the casting is allowed to cool further. When cold, the bimetallic plate is removed from the mold, the gates and the excess metal at the back of the plate are cut off and the plate cleaned. Also, as the cladding does not extend over margins of the substrate by which the substrate is clamped between the mold sections, such margins also are cut-off to provide a bimetallic plate which is 1800×1000 mm in area and which has a thickness of 10 mm of cladding of white iron on 10 mm thick substrate steel.

In forming the mold cope section for initial trials, fast-response type R and bare-tip type K thermocouples were installed in the cope mold so that they extended through the sand into the overlay cavity. The type R thermocouples were used to measure the cast metal temperature above the substrate after casting and the function of the type K thermocouples is to measure the flow speed and flow pattern of the cast metal. During the course of the experimental program it was found that the response time of the type R thermocouples was almost identical to that of the type K thermocouples and only type R thermocouples were used after that.

The bimetallic plate produced by the trials was found to be of excellent quality. While some plates were found to be slightly curved on cooling, this curvature was such that it could be removed. The white iron cladding was found to be substantially defect free and to have a good degree of uniformity in its thickness. Also, the cladding was found to have achieved a sound diffusion bond with the substrate characterized by a narrow bond zone exhibiting substantially no evidence of fusion of the substrate. Also, the control means were similarly incorporated in the cladding layer.

The trials indicate that to produce large bimetallic plate of good quality, it is necessary that:

(a) To achieve good bonding everywhere, in the case of providing cladding of high chromium white cast iron on a steel substrate, the temperature at the melt front should not be allowed to drop below about 1400° C. at any position in the mold as the metal flows over the substrate, with the substrate at a suitable preheat temperature.

(b) The cast metal must flow substantially evenly over the whole of the substrate surface.

(c) To avoid the use of excessively high superheat temperatures in the melt, pouring must be fast.

(d) Preheat furnace removal and mold clamping has to be done very quickly to minimize heat loss from the preheated substrate and from the melt.

(e) To save time, mold sealing must be achieved without the use of external sealing aids.

Finally, it is to be understood that various alterations, modifications and/or additions may be introduced into the constructions and arrangements of parts previously described without departing from the spirit or ambit of the invention.

What is claimed is:

1. A process for the production of composite bimetallic plate, wherein the process comprises the steps of:

(a) rendering a major surface of a substrate plate formed of a first metal substantially oxide-free;

(b) providing a suitable coating over said oxide-free major surface whereby said major surface is protected against oxidation;

(c) preheating the substrate plate to a sufficient temperature;

(d) positioning the substrate plate in a mold cavity of a mold with said major surface facing upwardly and substantially horizontally to thereby fill a lower portion of the depth of the mold cavity;

(e) securing the substrate plate in the mold cavity; and (f) casting a cladding of a second metal over said major surface of the substrate plate to form, with the substrate plate, said bimetallic plate wherein said cladding is cast by pouring, at a sufficient superheated temperature, a melt of the second metal for flow of the melt into the mold cavity to fill an upper portion of the depth of the mold cavity, wherein the securing step (e) secures the substrate plate whereby the substrate plate is substantially restrained against buckling during the casting step (f), and wherein the temperature to which the substrate plate is preheated in step (c) and the superheated temperature of step (f) achieve an overall heat energy balance between the first and second metals whereby a diffusion bond substantially free of fusion of the major surface of the substrate plate is achieved therebetween on solidification of the melt;

and wherein the process further comprises the steps of:

(g) causing the melt poured in step (f):

(i) to flow in at least one elongate runner which extends along a first edge of the substrate plate, and (ii) to enter the mold cavity through a series of gates providing communication between the runner and the mold cavity along said first edge of the substrate plate, whereby the melt is at substantially the same pressure at each gate and on entering the mold cavity forms a laterally extending melt front along said first edge of the substrate plate; and (h) causing the melt to fill the upper portion of the mold by said melt front advancing over said major surface away from said first edge at a rate which is substantially uniform across the lateral extent of the melt front, whereby attainment of the required heat energy balance is facilitated.

2. The process of claim 1, wherein the first metal of which the substrate plate is formed is selected from titanium, nickel, cobalt, ferrous alloys, titanium-base alloys, nickel-base alloys and cobalt-base alloys.

3. The process of claim 1, wherein the second metal to form the cladding is selected from copper, nickel, cobalt, ferrous alloys, copper-base alloys, nickel-base alloys and cobalt-base alloys.

4. The process of claim 1, wherein the melt front advances over said major surface in step (h) at a rate of from about 0.3 m/s to about 1.0 m/s.

5. The process of claim 4, wherein the melt front advances at a rate of from about 0.4 m/s to about 0.8 m/s.

6. The process of claim 1, wherein the major surface of the substrate plate has an area of from at least about 0.84 $m^2$ up to about 3.5 $m^2$.

7. The process of claim 1, wherein the step (a) of rendering the said major surface of the substrate plate substantially oxide-free is conducted by a process selected from sand-blasting, grit-blasting, shot-blasting, abrading by a wheel or belt sander and pickling.

8. The process of claim 1, wherein the step (b) of providing a suitable coating over said major surface of the substrate plate is conducted by applying flux over said surface and melting the flux during preheating to form a protective film.

9. The process of claim 1, wherein the step (b) of providing a suitable coating over said major surface of the substrate plate is conducted by deposition of a suitable metal.

10. The process of claim 9, wherein said suitable metal is deposited by electroless or electrolytic plating.

11. The process of claim 1, wherein the step (b) of providing a suitable coating over said major surface of the substrate plate is conducted by applying a coating of colloidal graphite containing a silicate binder.

12. The process of claim 1, wherein said substrate plate is rectangular and wherein the melt front is formed adjacent to and along a first edge at one end of the substrate plate and is advanced to an end of the substrate plate which is opposite to the one end.

13. The process of claim 1 wherein the lateral extent of the melt front extends over substantially the full lateral extent of the substrate plate.

14. The process of claim 1, wherein the melt is caused to enter the mold cavity in a manner providing for substantial equalization of melt pressure at each of the gates.

15. The process of claim 14, wherein equalization of melt pressure is attained at least in part by disposing the substrate in the mold cavity such that the major surface of the substrate plate, while substantially horizontal, is inclined upwardly in the direction of melt front advance whereby, across the lateral extent of the melt front, the melt front is constrained to a substantially uniform advance by the influence of gravity.

16. The process of claim 1, wherein the step (c) of preheating of the substrate plate is conducted with the substrate plate positioned in the mold cavity.

17. The process of claim 1, wherein the securing step (e) causes the substrate plate to be restrained in the mold cavity in a manner substantially offsetting buckling or deformation due to thermal effects and maintenance of substantially uniform cladding thickness.

18. The process of claim 17, wherein the securing step (e) includes providing a to series of threaded metal studs welded to the underside of the substrate plate and tightening nuts on the studs against a drag mold frame of the mold.

19. The process of claim 17, wherein the securing step (e) is conducted by utilizing the clamping force by which drag and cope sections of the mold are clamped together thereby generating compressive loads acting to press the substrate plate to an approximately flat condition.

20. The process of claim 19, wherein a series of laterally spaced, longitudinally extending metal strips are tack-welded to the major surface of the substrate plate, with the strips dimensioned to form channels of a depth substantially corresponding to the required cladding thickness, and the clamping force acts to press the substrate plate by the cope section bearing against the strips.

21. The process of claim 17, wherein the securing step (e) includes tack welding a plurality of metal chaplets to the major surface of the substrate plate, with the chaplets having a thickness corresponding to the required cladding thickness whereby the clamping force by which drag and cope sections of the mold are clamped together acts to press the substrate plate by the cope section bearing against the chaplets.

22. A molding apparatus for use in producing composite bimetallic plate, comprising:

a mold having a drag section and a cope section which together define a mold cavity having a form substantially corresponding to bimetallic plate to be produced therein;

at least one elongate runner defined by the mold and extending along a first end of the mold cavity; and a series of laterally spaced gates which are defined by the drag and cope sections of the mold and which provide communication between the at least one runner and the mold cavity at said first end;

wherein a lower portion of the mold cavity is defined by the drag section of the mold and has a substantially flat, substantially horizontal support surface which extends between said first end and a second end of the mold cavity remote from the first end, and on which a substrate metal plate is positionable whereby a major surface of the plate faces upwardly and is substantially horizontal; and wherein the apparatus further comprises means for securing a substrate positioned on said support surface and thereby restraining the substrate plate against buckling during the casting of cladding thereon.

23. Apparatus according to claim 22, further including means for moving the cope section vertically between a lowered position in which the cope and drag sections are able to be damped together to close the mold and a raised position enabling a substrate to be positioned in the part of the mold cavity defined by the drag section.

24. Apparatus according to claim 22, further including heating means which, with the cope section of the mold moved away from the drag section, is movable from a retracted position to an advanced position over the drag section whereby the heating means is able to preheat a substrate positioned in the drag section.

* * * * *